United States Patent [19]

Jefferson

[11] 4,358,256

[45] Nov. 9, 1982

[54] FUEL INJECTION PUMPING APPARATUS

[75] Inventor: John R. Jefferson, Rainham, England

[73] Assignee: Lucas Industries Limited, Birmingham, England

[21] Appl. No.: 224,493

[22] Filed: Jan. 13, 1981

[30] Foreign Application Priority Data

Feb. 2, 1980 [GB] United Kingdom ..... 8003565

[51] Int. Cl.[3] ..... F02D 1/04

[52] U.S. Cl. ..... 417/462; 123/450

[58] Field of Search ..... 417/462; 123/450

[56] References Cited

U.S. PATENT DOCUMENTS 3,025,797 3/1962 Hutchen ..... 417/462 X 3,091,230 5/1963 Evans et al. ..... 417/462

*Primary Examiner*—Alan Cohan

[57] ABSTRACT

A fuel injection pumping apparatus comprises a rotary distributor member mounting a pumping plunger in a transverse bore. A cam ring is provided to impart inward movement to the plunger as the distributor member rotates and the cam ring is movable angularly in accordance with speed by a fluid pressure operable device. Stop rings are mounted on the opposite sides of the cam ring and these are angularly adjustable to alter the allowed outward movement of the plunger. The stop rings are connected by a bridging member mounting a peg. The peg mounts a lever having a cam surface engageable with a stop member and the lever is movable by means of the cam ring so that the setting of the stop rings varies with speed.

4 Claims, 3 Drawing Figures

FUEL INJECTION PUMPING APPARATUS

This invention relates to liquid fuel injection pumping apparatus for supplying fuel to an internal combustion engine and of the kind comprising a housing, a rotary distributor member mounted in the housing and adapted in use to be driven in timed relationship with an associated engine, a bore formed in the distributor member, a pumping plunger located in said bore and arranged to be moved inwardly by the action of a cam located within the housing, means for supplying fuel to said bore to effect outward movement of the plunger, passage means for conveying fuel from said bore to an outlet during the inward movement of the pumping plunger by said cam, speed responsive means for adjusting the setting of said cam so that the commencement of delivery of fuel through said outlet will vary in accordance with the speed at which the distributor member is driven, and stop means operable to determine the maximum outward movement of the plunger, thereby to control the maximum amount of fuel which can be supplied to the associated engine.

It is known to vary the extent of outward movement of the plunger in accordance with the speed at which the associated engine is driven. One reason for doing this is because the maximum amount of fuel which can be supplied to an engine without exceeding the permitted smoke level in the engine exhaust, varies with the speed of the engine. In addition, it is desirable in the case where the engine is the engine of a road vehicle, to modify the maximum amount of fuel in accordance with the speed of the engine to provide what is known in the art as "torque control". For this purpose it is known to provide a speed responsive means additional to that provided for positioning the cam, to control the setting of said stop means. The provision of a second speed responsive means adds to the expense of the apparatus and also its bulk.

The object of the invention is to provide an apparatus of the kind specified in a simple and convenient form.

According to the invention in an apparatus of the kind specified said stop means comprises a movable member for engagement by said plunger or a part associated therewith, a lever pivotally mounted on said movable member, a stop member carried by the housing, said lever having a contoured stop surface for engagement with said stop member, said stop surface being shaped so that upon angular movement of said lever, said movable member will move to vary the maximum outward movement of the plunger and means connecting said cam with said lever whereby movement of the cam under the action of the speed responsive means will effect angular movement of said lever and hence adjustment of said cam.

An example of an apparatus in accordance with the invention will now be described with reference to the accompanying drawings in which.

Figure 1:
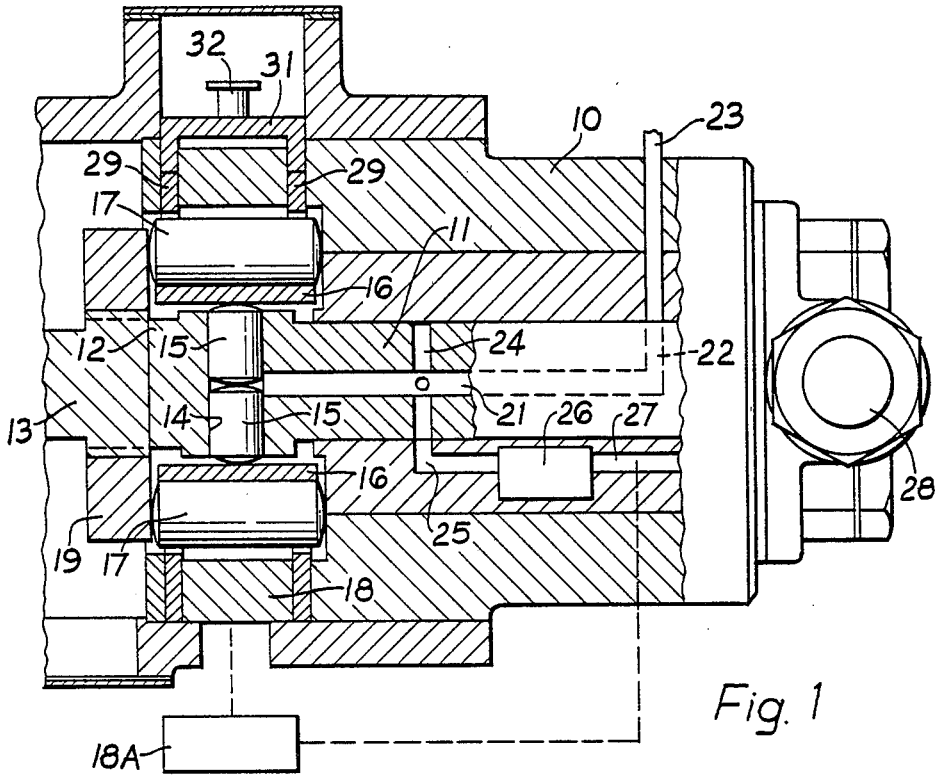
FIG. 1 is a diagrammatic sectional side elevation of an apparatus.

Referring to FIG. 1 of the drawings the apparatus comprises a multi-part housing 10 in which is mounted a rotary cylindrical distributor member 11. The distributor member has an enlarged portion 12 which is driven from a drive shaft 13 the latter in use, being driven in timed relationship with an associated compression ignition engine. Formed in the distributor member 11 is a diametrically disposed bore 14 in which is mounted a pair of plungers 15 and these at their outer ends, engage shoes 16 which carry rollers 17 respectively engaging the internal peripheral surface of an annular cam ring 18 surrounding the enlarged portion 12 of the distributor member.

Figure 2:
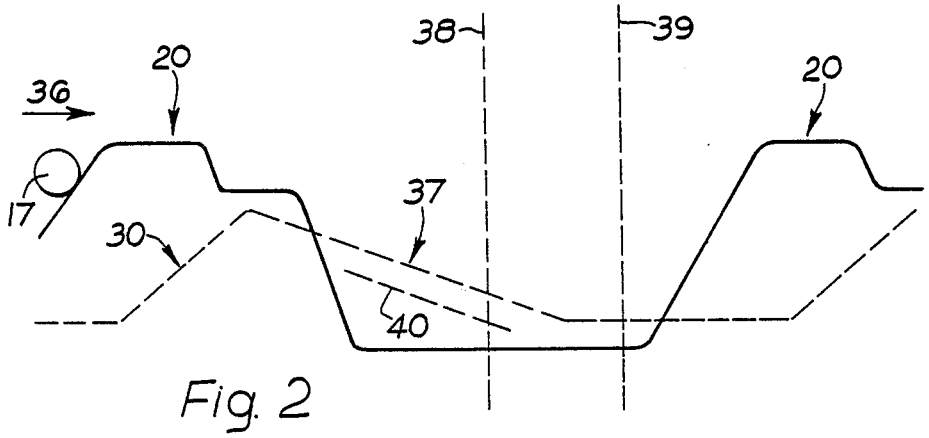
FIG. 2 is a diagram of the cam lobe profile and a profile of a stop ring forming part of the apparatus seen in FIG. 1.

The cam ring has a plurality of inwardly extending cam lobes the profile of which is seen at 20 in FIG. 2. The shoes 16 are carried in slots formed in a sleeve 19 which is secured to or forms part of the drive shaft 13. Formed in the distributor member is a longitudinal passage 21 which at one end communicates with a radially disposed delivery passage 22. This is disposed to register in turn with outlet ports 23 formed in the housing and connected in use, to the injection nozzles respectively of the associated engine. The longitudinal passage 21 also communicates with a plurality of inlet passages 24 which are formed in the distributor member which are arranged to communicate in turn, with an inlet port 25 which is formed in the body. The inlet port 25 communicates by way of a fuel control device 26 conveniently in the form of an adjustable throttle, with a fuel supply passage 27. This latter passage communicates with an outlet of a low pressure fuel supply pump the rotary part of which is carried by the distributor member. The pump has a fuel inlet 28 and it is provided with a relief valve whereby the outlet pressure that is to say the pressure in the passage 27, varies in accordance with the speed at which the apparatus is driven.

In operation when the rollers and plungers are moved inwardly by the action of the cam lobes, fuel is displaced through an outlet 23 and during further rotation of the distributor member the delivery passage 22 moves out of register with an outlet and an inlet passage 24 moves into register with the inlet port 25. Fuel flows to the bore 14 the amount of fuel being controlled by the setting of the throttle. Thereafter the cycle is repeated and fuel is supplied to the outlets in turn during successive inward movements of the plungers. In order to vary the timing of delivery of fuel the cam ring 18 is angularly adjustable in known manner, within the housing and a speed responsive means generally indicated at 18*a*, is provided. Conveniently this takes the form of a spring loaded piston located within a cylinder, the cylinder being connected to the passage 27. A servo valve may be provided between the passage 27 and the cylinder.

In order to control the maximum amount of fuel which can be supplied by the apparatus to the associated engine irrespective of the setting of the throttle, there is mounted in the body a pair of stop rings 29. The rings are disposed on opposite sides of the cam ring 18 and they are angularly movable within the housing and have an internal profile as shown at 30 in FIG. 2. The stop rings are interconnected by means of a bridging member 31 which extends over the cam ring and the bridging member mounts an upstanding peg 32.

The operation of the stop rings will now be discussed in relation to FIG. 2. In FIG. 2 a roller 17 is shown engaging one of the cam lobes and the direction of movement of the roller as it is driven around the cam ring is shown by the arrow 36. It will be seen that the roller is engaging the leading flank of the cam lobe. During movement in the direction of the arrow 36 upward movement of the roller 17 will occur and this corresponds to inward movement of the associated plunger 15. Fuel is therefore being supplied through an outlet 23 and when the roller reaches the crest of the cam lobe there is a delay during which no movement of the plunger takes place. This is followed by a limited outward movement of the plunger to reduce the pressure in the various passages within the pump and also to reduce the pressure in the pipe line connecting the outlet with the nozzle. Again there is a short delay during which time the delivery passage 22 moves out of register with an outlet port 23 and an inlet passage 24 moves into register with the inlet port 25. The cam lobe falls to the base circle of the cam and the plunger can therefore move outwardly as fuel is supplied from the low pressure pump.

The internal profile of the stop rings 29 is shown at 30 and the important portion thereof is a portion 37 with which the roller 17 can engage during the period when fuel can be supplied to the bore. The dotted line 38 indicates the closure of the inlet port 25 to an inlet passage and the further dotted line 39 indicates the opening of the delivery passage to an outlet 23. Assuming for the moment that the throttle is set so that there is substantially no restriction to the flow of fuel, then the roller will engage the portion 37 of the internal peripheral surface of the stop rings to restrain the outward movement of the rollers and therefore the plungers. Once the intel port has been closed then no further fuel can be supplied to the bore and the position of the rollers and plungers will be such that the maximum amount of fuel is supplied by the pump to the associated engine. At least the plungers will be held against movement until the rollers again engage the leading flanks of the cam lobes 20. It will be noted that before they do this, the delivery passage 22 will be brought into communication with an outlet 23. Furthermore, it should be noted that if the throttle is set to allow a restricted supply of fuel only, then the rollers may not engage with the portion 37 of the stop rings.

If the stop rings are moved angularly then the maximum amount of fuel which can be supplied to the engine will vary and if they are moved to the position shown by the dotted line 40 in FIG. 2, an additional quantity of fuel can be supplied to the engine. Conversely, if the stop rings are moved in the opposite direction, then the maximum amount of fuel which can be supplied to the engine will be reduced.

Figure 3:
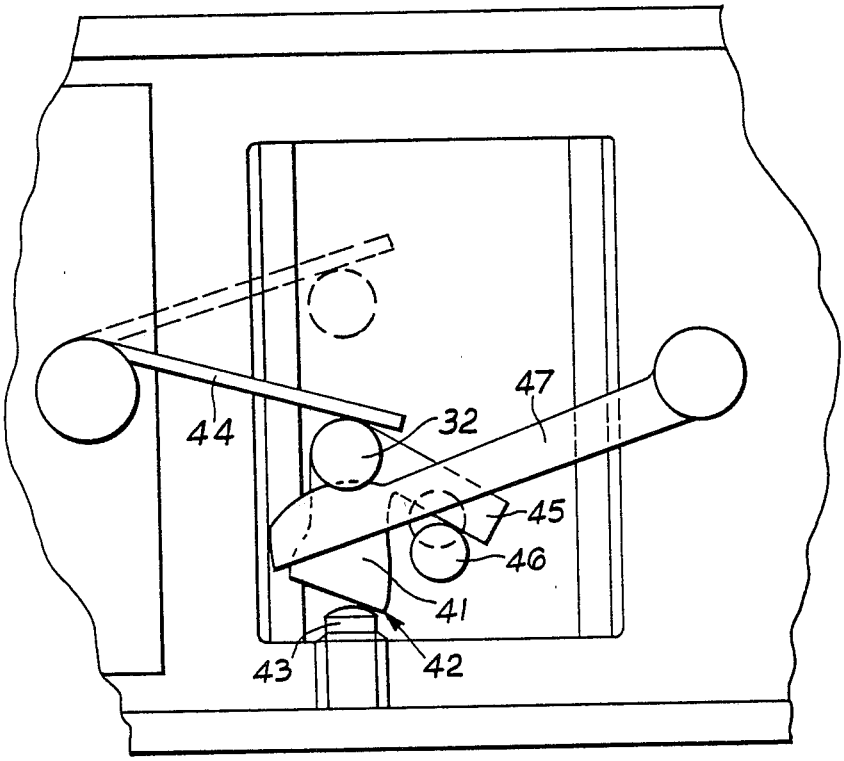
FIG. 3 is a plan view of a part of the apparatus not seen in FIG. 1.

For the reasons explained earlier it is desirable to be able to adjust the position of the stop rings in accordance with the speed of the associated engine. For this purpose and as shown in FIG. 3, the peg 32 constitutes the pivot of a lever 41. The lever 41 has a contoured stop surface 42 which is engageable with an adjustable stop member 43. The stop surface is contoured so that upon angular movement of the lever 41, the position of the peg 32 relative to the stop member 43 will vary and hence the maximum amount of fuel which can be delivered to the engine will also vary. The peg 32 is engaged by a coiled torsion spring 44 so that the stop surface is biassed into engagement with the stop member 43.

Means is provided for effecting angular movement of the lever 41 and this comprises an arm 45 which is integrally formed with the lever and projects in a generally lateral direction therefrom. The arm 45 is engageable by a pin 46 which extends from the cam ring 18 and the arrangement is such that as the cam ring moves angularly so the position of the arm 45 and lever 41 about the peg 32 will vary.

As shown in FIG. 3, movement of the pin 46 from the full line to the dotted position, occurs with increasing engine speed and the profile of the contoured stop surface is such that movement of the peg 32 against the action of the spring 44 will take place resulting in movement of the portion 37 of the profile of the stop ring towards the position shown at 40 in FIG. 2.

A further lever 47 is provided which can be engaged with the peg 32, the lever being operable to move the stop rings 29 to allow an additional amount of fuel to be supplied for starting purposes.

I claim:

1. A liquid fuel injection pumping apparatus for supplying fuel to an internal combustion engine and of the kind comprising a housing, a rotary distributor member mounted in the housing and adapted in use to be driven in timed relationship with an associated engine, a bore formed in the distributor member, a pumping plunger located in said bore and arranged to be moved inwardly by the action of a cam located within the housing, means for supplying fuel to said bore to effect outward movement of the plunger, passage means for conveying fuel from said bore to an outlet during the inward movement of the pumping plunger by said cam, speed responsive means for adjusting the setting of said cam so that the commencement of delivery of fuel through said outlet will vary in accordance with the speed at which the distributor member is driven, stop means operable to determine the maximum outward movement of the plunger, thereby to control the maximum amount of fuel which can be supplied to the associated engine, said stop means comprising a movable member for engagement by said plunger or a part associated therewith, a lever pivotally mounted on said movable member, a stop member carried by the housing, said lever having a contoured stop surface for engagement with said stop member, said stop surface being shaped so that upon angular movement of said lever, said movable member will move to vary the maximum outward movement of the plunger and means connecting said cam with said lever whereby movement of the cam under the action of the speed responsive means will effect angular movement of said lever and hence adjustment of said cam.

2. An apparatus according to claim 1 in which said movable member comprises a pair of stop rings positioned on opposite sides respectively of said cam and a peg carried on a bridging member connecting said stop rings, said lever being carried on said peg.

3. An apparatus according to claim 2 in which the means connecting said lever with said cam comprises an arm connected with said lever and a pin carried by said cam and engageable with said arm to vary the position of said lever.

4. An apparatus according to claims 2 and 3 including resilient means biasing said lever into contact with said stop member.

* * * * *